US005826786A

United States Patent [19]

Dickert

[11] Patent Number: 5,826,786

[45] Date of Patent: Oct. 27, 1998

[54] CUP HOLDER SLEEVE IN PRE-ASSEMBLED FLAT-FOLDED FORM

[76] Inventor: James Dickert, 1657 Old Oak Pl., Darien, Ill. 60651

[21] Appl. No.: 611,722

[22] Filed: Mar. 6, 1996

[51] Int. Cl.[6] ..... B65D 3/22

[52] U.S. Cl. ..... 229/403; 220/903; 229/935

[58] Field of Search ..... 229/117.06, 400, 229/403, 405, 935, 4.5; 220/903

[56] References Cited

U.S. PATENT DOCUMENTS

| | | | |
|---|---|---|---|
| 1,738,779 | 12/1929 | Lockwood | 229/405 |
| 2,097,899 | 11/1937 | Smith | 229/935 X |
| 3,432,086 | 3/1969 | Galloway et al. | 229/935 X |
| 5,205,473 | 4/1993 | Coffin, Sr. | 229/403 |
| 5,209,367 | 5/1993 | Van Musscher et al. | 220/903 X |
| 5,226,585 | 7/1993 | Varano | 229/403 X |
| 5,229,182 | 7/1993 | Eisman et al. | 229/935 X |
| 5,385,260 | 1/1995 | Gatcomb | 229/403 X |
| 5,425,497 | 6/1995 | Sorenson | 229/403 X |
| 5,454,484 | 10/1995 | Chelossi | 229/4.5 X |

*Primary Examiner*—Stephen P. Garbe
*Assistant Examiner*—Christopher J. McDonald
*Attorney, Agent, or Firm*—Evelyn M. Sommer

[57] ABSTRACT

A cup holder sleeve is formed in pre-assembled, flat-folded form by diecutting a flat, elongated band from blank stock material so as to have top and bottom arcuate edges concentric to and in parallel with each other, fold lines scored into the band at spaced apart positions tapering toward each other, and side edges at opposite ends of the band. The opposite ends are folded flat at the fold lines so that the side edges overlap each other and are glued together at their overlapping surfaces. The flat-folded form allows for compact storage. The pre-assembled sleeve can be readied for use simply by squeezing on the outside surfaces so as to bow out the flat-folded band into an annular tapered sleeve with opened top and bottom ends for inserting a cup therein. In a preferred embodiment, the sleeve is made of paperboard material and is printed with graphics and embossed with a pattern to provide an insulating layer as well as better gripping of the sides of the cup. The diecutting, folding, and glueing of the sleeve can be done in one production process for ease of fabrication and at a low cost.

7 Claims, 3 Drawing Sheets

CUP HOLDER SLEEVE IN PRE-ASSEMBLED FLAT-FOLDED FORM

FIELD OF THE INVENTION

This invention generally relates to a cup holder sleeve, and more particularly, to one that is improved in pre-assembled, flat-folded form.

BACKGROUND ART

In the food service industry, a premium is placed on consumer service disposables that can be stored compactly and can be readied for use quickly and conveniently. In food establishments, it is common to serve hot and cold beverages and other liquids such as soups. Since it is inconvenient and more costly to stock supplies of hot and cold cups made of different materials, thicknesses, or dimensions, it has become desirable to use a single stock of cups for both hot and cold liquids and provide instead an insulating holder sleeve or collar which can slip over the outside of the cup when used for hot liquids.

One form of cup holder sleeve is disclosed in U.S. Pat. No. 5,425,497 consisting of a flat, elongated sheet or band in arcuate form with notched ends being made of paperboard material embossed with nubs and semi-shperically shaped depressions intended to provide an insulating layer as well as gripping of the sides of the cup. In order to be used for holding a cup, the flat band must be rolled in a circle and then its notched ends must be interlocked to each other to form a tapered collar or sleeve in which a cup can be inserted. This type of cup holder sleeve has the disadvantage that it must be assembled on site by the food service worker or the customer which can be inconvenient and take additional time during food service. Also, the need to interlock the notched ends on-site risks possible breakage or improper assembly. Other types of sleeves also require on-site assembly of separate ends with a fastener such as a pressure-sensitive strip.

It is therefore desirable to have a cup holder sleeve which is pre-assembled to allow its immediate use without taking up any time on site, yet can be stored flat without any complicated handling.

SUMMARY OF THE INVENTION

In the present invention, a cup holder sleeve comprises a flat, elongated band having top and bottom edges in arcuate form which are concentric to and in parallel with each other, first and second fold lines scored into the band which are spaced apart from each other at respective intermediate positions of the band tapering toward each other, and first and second side edges at opposite ends of said elongated band, wherein the opposite ends of said band are folded flat at said first and second fold lines such that said first and second side edges overlap each other, and said first and second side edges are adhered together with adhesive applied at mutually overlapping surfaces thereof, whereby said cup holder sleeve is pre-assembled in a flat-folded form and can be readied for use simply by squeezing on outside surfaces of said flat-folded band around said first and second fold lines so as to bow out the band into an annular tapered sleeve with opened top and bottom ends for inserting a cup having tapered sides therein.

In a preferred embodiment, the band is made of paperboard material and embossed with preferred patterns over its inside and outside surfaces in order to provide an insulating layer between the outside surface and a cup inserted in the sleeve, as well as provide a better gripping of the sides of the cup. More particularly, the embossure patterns are positive/negative with selected patterns on the front and back surfaces. The patterns can be selected from a limitless number of designs, including custom designs selected by the customer (vendor) for the cup holders. The present invention also encompasses the corresponding method of forming the pre-assembled flat-folded cup holder sleeve.

Other objects, features, and advantages of the present invention will become apparent from the following detailed description of the invention with reference to the accompanying drawings, as follows:

DETAILED DESCRIPTION OF THE INVENTION

Figure 1:
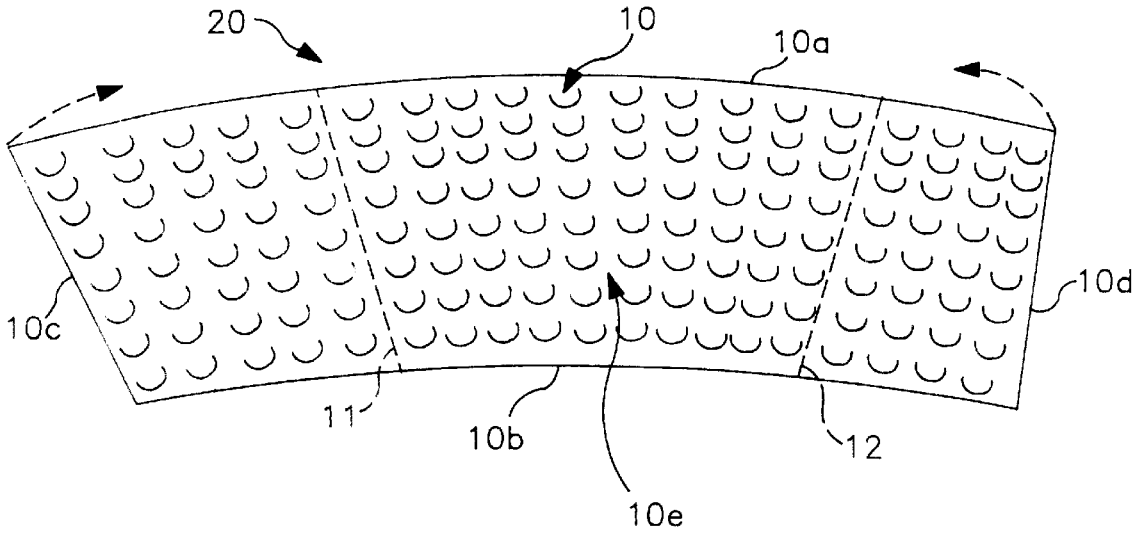
FIG. 1 depicts the starting configuration of an elongated band for forming the cup holder sleeve in accordance with the invention.

As shown in FIG. 1, a cup holder sleeve 20 in accordance with the present invention is formed from an elongated band 10 made of paperboard material. The band has a top edge 10*a* and a bottom edge 10*b* both in arcuate form concentric to and in parallel with each other. It also has first and second fold lines 11, 12 which are scored, slit cut, or perforated into the band material on an inside surface (facing the viewer in FIG. 1) thereof. The fold lines 11, 12 are spaced apart from each other at respective intermediate positions of the band and taper toward each other toward a concentric point (not shown). The opposite ends of the band are defined by first and second side edges 10*c* and 10*d*, respectively.

The concentric top and bottom arcuate edges and tapered fold lines result in a truncated conical, tapered form. Instead of a smooth curve, the top and bottom edges may be cut with a decorative pattern for a more pleasing appearance. The shape of the top edge will mirror the bottom edge when successive units are formed by a single cut.

Figure 2:
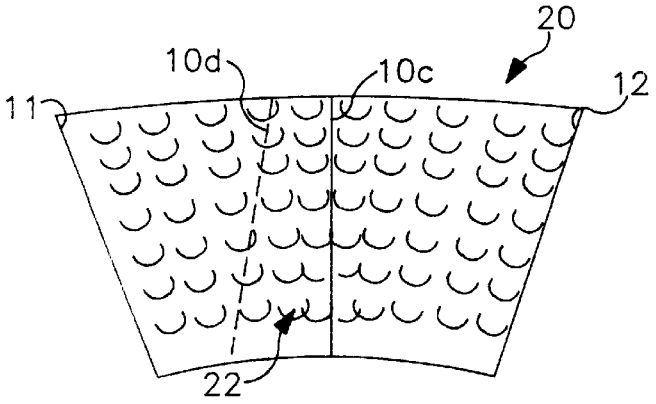
FIG. 2 depicts the band flat-folded at its fold lines and glued together at its overlapping ends to form the pre-assembled cup holder sleeve.

Referring to FIG. 2, the cup holder sleeve is pre-assembled by folding the second side edge 10*d* at fold line 12 flat under and so as to be overlapped by the first side edge 10*c* folded flat at fold line 11 (folding is in the direction of the dashed arrows shown in FIG. 1). The overlapping edges are adhered together with adhesive applied at mutually overlapping surfaces in the shaded area referenced by numeral 22.

Figure 3:
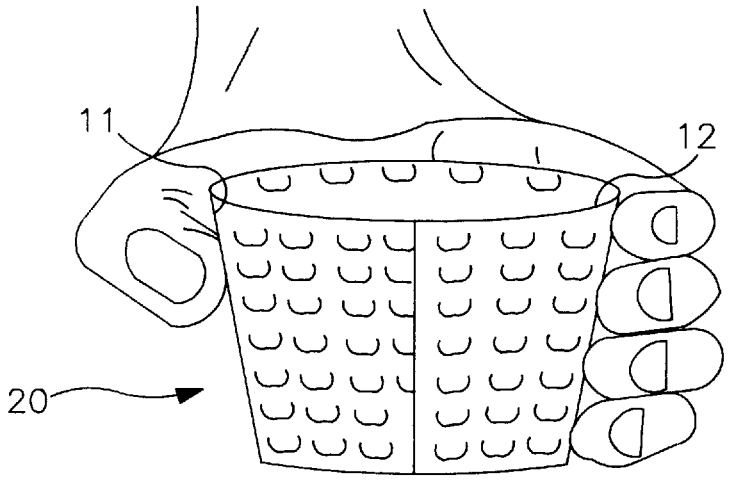
FIG. 3 illustrates how the pre-assembled, flat-folded cup holder sleeve is opened for use by squeezing on its outside surfaces at the fold lines.
Figure 4:
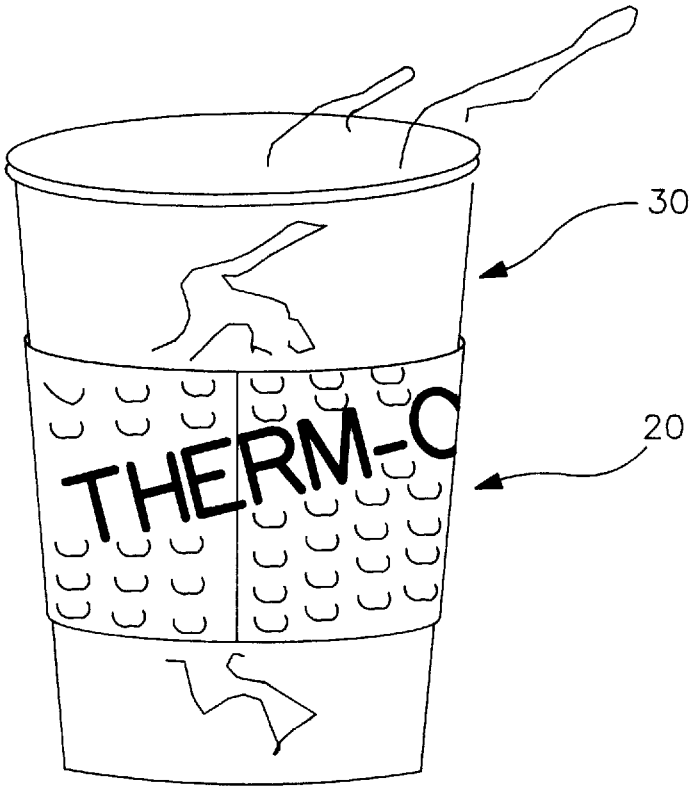
FIG. 4 illustrates the cup holder sleeve having a cup inserted in it.

The resulting cup holder sleeve is thus pre-assembled in a flat-folded form for compact storage and convenient handling. As shown in FIG. 3, the cup holder sleeve is quickly and conveniently readied for use by squeezing on the outside surfaces of the flat-folded band around the first and second fold lines 11, 12 so as to bow out the band into an annular sleeve with opened top and bottom ends. As illustrated in FIG. 4, a cup 30 having tapered sides is held in the cup holder sleeve 20 by inserting the cup through its opened ends and press fitting therein.

Figure 5:
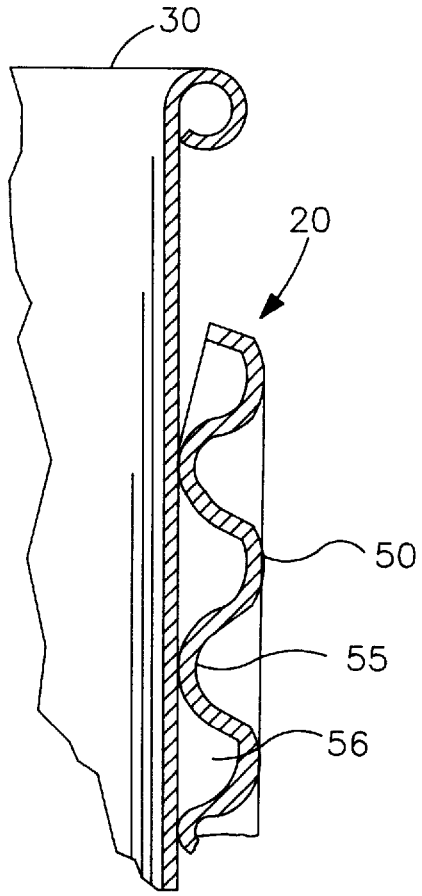
FIG. 5 illustrates the embossment on both sides of the elongated band used to form the sleeve in a preferred embodiment of the present invention.

Turning now to FIG. 5, cup holder sleeve 20 in accordance with the present invention is folded at fold line 12 so that side edge 10*d* lies on the portion of cup holder sleeve 20 between fold line 12 and fold line 11. In FIG. 5, the band is not folded at fold line 11. As can been seen from FIG. 5, both sides of the cup holder sleeve 20 bear embossments, i.e., there are embossments on the side that is to be the sleeve interior between side edge 10*c* and fold line 11 as well as on the side that is to be the sleeve exterior between side edge 10*d* and fold line 12.

In the preferred embodiment, the band 10 is embossed with a three-dimensional physical positive/negative patterns 10*e* over the inside and outside surfaces of the band in order to provide an embossed spacing which acts as an insulating layer between the outside surface of the sleeve 20 and the sides of a cup 30 inserted against the inside surface of the sleeve. Embossing the surfaces of the sleeve also provides a better gripping of the inner surface against the sides of the cup so retain it frictionally so that the cup is not easily jolted out of the sleeve. The embossing of the outer surface can also provide a pleasant tactile feel and grip to the user as well as an aesthetic appearance. A non-skid or thermally actuated interior coating can also be applied on the interior side during printing of the sleeve blank to provide or enhance the cup-to-sleeve adhesion.

Figure 1A:
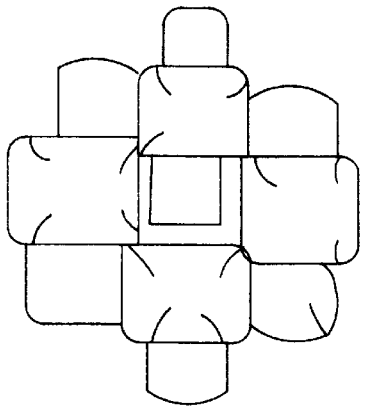
FIG. 1A shows a preferred pattern for the sleeve.

The embossing pattern can take the form of nubs and depressions formed between mutual calendar rolls so as to form complementary patterns which are mirror images of each other, for example, as described in U.S. Pat. No. 5,425,497. However, it is preferred that non-mirror image patterns be used, such as by embossure with differently patterned calendar rolls into each surface so as to provide different insulating, gripping, and/or aesthetic effect. FIG. 1A shows an embossure pattern for the outside and inside surfaces of the sleeve which is positive/negative in terms of having alternating raised areas and depressed areas, but is not a mirror image of the one formed on the opposite surface of the sleeve. Also, aesthetic patterns maybe designed to represent a particular vendor. The outside and/or inside surfaces of the sleeve may also be printed with graphics as desired by the supplier or a vendor, as indicated in FIG. 4.

The corresponding method of forming the pre-assembled flat-folded cup holder sleeve will now be described. The cup holder sleeve is diecut from a blank sheet or web of stock material. The blank sheet or web may be embossed by a pair of calendar rolls prior to diecutting the bands therefrom. Similarly, printing of the outside and/or inside surface(s) can be carried out at an upstream position before embossing or cutting. Alternatively, the stock material can be printed and embossed beforehand. The top, bottom, and side edges of the elongated band 10 are diecut and the fold lines 11 and 12 are scored, slit cut, or perforated at the same time. As each band is diecut, the ends of the band can be folded and glued together in a subsequent tandem operation or in a separate gluing operation. The performance of these blank handling steps is well known in the paper products industry and is not described further herein. All of the steps of printing, embossing, diecutting, scoring, folding, and gluing can be done in one production process or in sequential or separate fabrication steps, as is well known in this field. The paperboard material can be a selected kraft, news, or white-lined recycled or virgin paperboard. Other types of materials, such as foamboard, or other laminate combinations may be used to make this product.

The pre-assembled (glued), flat-folded sleeve is easily opened by a squeezing motion which takes up hardly any time at the point of use. No hand assembly of interlocking parts or adhesive ends is required. Thus, the sleeve can even be handled by the ultimate user, thereby saving the vendor further time. The tapered dimensions of the sleeve can be selected to be able to accomodate two or more cup sizes with the same sleeve. Thus, the number of sleeve types that have to be stocked can be few or even a single type. The cup holder sleeve in accordance with the invention can be fabricated easily in one production process or in separate or sequential steps, and at a low cost.

Alternate features for the cup holder sleeve include providing a non-skid coating, such as a silica layer, or a thermoplastic coating on the inside surface of the sleeve to improve adherence to the cup. The top and bottom edges of the sleeve can be diecut with extensions, waves, or other shapes for aesthetics and/or secure gripping characteristics. The sleeve may be made of other materials, such as fiber mixtures with paper fiber, nonwoven materials, or even plastic. The sleeves may be dispensed from a free-standing or wall-mounted holder containing a stack of the flat-folded units.

Numerous modifications and variations may be made in light of the principles of the invention disclosed above. The invention and all modifications and variations thereof are included within the definition of the following claims.

I claim:

1. A cup holder sleeve comprising a flat, elongated paperboard band having a) a top and a bottom edge in arcuate form which are concentric to and in parallel with each other;

b) a first and a second side edge at opposite ends of said elongated band; and c) a first and a second fold line scored into the band, said fold lines are spaced apart from each other at respective intermediate positions of the band tapering toward each other wherein at least one of said tapering fold lines forms a four sided polygon with said top and bottom edge and one of said side edges in which the bottom edge is longer than the top edge;

wherein the opposite ends of said band are folded flat at said first and second fold lines such that said first and second side edges overlap each other, and said first and second side edges are adhered together with adhesive applied at mutually overlapping surfaces thereof, said band thereby being pre-assembled and flat-folded so that it can be stored compactly and easily opened by a squeezing motion.

2. A cup holder sleeve according to claim 1, wherein said paperboard material of said band is embossed with a pattern over its inside and outside surfaces.

3. A cup holder sleeve according to claim 2, wherein said pattern is positive/negative and embossed as different patterns on said inside and outside surfaces.

4. A cup holder sleeve according to claim 2, wherein said embossed pattern is a selected pattern.

5. A cup holder sleeve according to claim 1, wherein said band and positions of the tapered fold lines are dimensioned such that the resulting sleeve can accomodate two or more cup sizes.

6. A cup holder sleeve according to claim 1, wherein said band has a coating applied on the inside surface of the sleeve to improve adherence to the cup, said coating selected from the group consisting of non-skid and thermoplastic coatings.

7. A cup holder sleeve according to claim 1 wherein said cup holder sleeve, when squeezed, assumes a substantially conical shape.

* * * * *

UNITED STATES PATENT AND TRADEMARK OFFICE

CERTIFICATE OF CORRECTION

PATENT NO. : 5,826,786

DATED : October 27, 1998

INVENTOR(S) : James Dickert

It is certified that error appears in the above-identified patent and that said Letters Patent is hereby corrected as shown below:

Col. 2, delete, lines 28-30, and insert therefore --Fig. 5 is a partial front sectional view of the combination shown in Fig. 4, showing the embossment on both sides of the elongated band.--

Signed and Sealed this

Twenty-third Day of February, 1999

*Attest:*

Q. TODD DICKINSON

*Attesting Officer*

*Acting Commissioner of Patents and Trademarks*